US008790045B2

(12) United States Patent
Cariou

(10) Patent No.: US 8,790,045 B2
(45) Date of Patent: Jul. 29, 2014

(54) FACING ELEMENT FOR USE IN A STABILIZED SOIL STRUCTURE

(75) Inventor: Richard Cariou, Anglet (FR)

(73) Assignee: Terre Armee Internationale, Velizy Villacoublay (FR)

( * ) Notice: Subject to any disclaimer, the term of this patent is extended or adjusted under 35 U.S.C. 154(b) by 131 days.

(21) Appl. No.: 13/638,566

(22) PCT Filed: Mar. 24, 2011

(86) PCT No.: PCT/EP2011/054572
§ 371 (c)(1),
(2), (4) Date: Sep. 28, 2012

(87) PCT Pub. No.: WO2011/120873
PCT Pub. Date: Oct. 6, 2011

(65) Prior Publication Data

US 2013/0022411 A1 Jan. 24, 2013

(30) Foreign Application Priority Data

Apr. 2, 2010 (EP) ..... 10305342

(51) Int. Cl.
*E02D 29/02* (2006.01)

(52) U.S. Cl.
USPC ..... 405/262; 405/284

(58) Field of Classification Search
CPC .. E02D 29/0241; E02D 29/0225; E02D 29/02
USPC ..... 405/262, 284, 285, 286
See application file for complete search history.

(56) References Cited

U.S. PATENT DOCUMENTS

| | | | | |
|---|---|---|---|---|
| 4,273,476 | A * | 6/1981 | Kotulla et al. | 405/284 |
| 4,824,293 | A * | 4/1989 | Brown et al. | 405/262 |
| 4,914,887 | A * | 4/1990 | Meheen | 405/284 |
| 5,207,038 | A | 5/1993 | Negri | |
| 5,839,855 | A | 11/1998 | Anderson et al. | |
| 6,224,295 | B1 | 5/2001 | Price et al. | |
| 6,443,662 | B1 * | 9/2002 | Scales et al. | 405/262 |
| 6,443,663 | B1 * | 9/2002 | Scales et al. | 405/262 |
| 6,447,211 | B1 | 9/2002 | Scales et al. | |
| 6,468,004 | B1 * | 10/2002 | Price | 405/262 |
| 6,884,004 | B1 * | 4/2005 | Scales et al. | 405/262 |
| 7,491,018 | B2 * | 2/2009 | Freitag et al. | 405/262 |

FOREIGN PATENT DOCUMENTS

| | | |
|---|---|---|
| DE | 1 759 484 A1 | 9/1971 |
| EP | 1 180 561 A1 | 2/2002 |
| FR | 2 868 447 A1 | 10/2005 |
| WO | WO 93/22506 | 11/1993 |
| WO | WO 99/16979 | 4/1999 |

* cited by examiner

*Primary Examiner* — Frederick L Lagman
(74) *Attorney, Agent, or Firm* — McKenna Long & Aldridge LLP

(57) ABSTRACT

A facing element (34) for use in a stabilized earth structure where the facing element comprises at least a hollow part (37) with an opening (36) on the rear face (32) wherein a cylindrical core (5) is arranged at least partly in the hollow part (37) and consists of two continuous parts (51, 52) where the first part (51) has a continuously decreasing size to an extremity (54) and the second part (52) has a continuously constant and/or decreasing size to an extremity (55) and wherein: $L_2 \geq 1.2 \times d_1$; and $A > 0.24 \times d_1^2$; wherein: $L_2$ is the distance between the extremity (54) of the first part (51) and the rear face (32); $d_1$ is the width of the cylindrical core (5) at the extremity (54) of the first part (51); A is the area of the cross section of the cylindrical core (5) in the plane (X, Z). Improved anchoring properties are accordingly obtained.

15 Claims, 7 Drawing Sheets

FACING ELEMENT FOR USE IN A STABILIZED SOIL STRUCTURE

This Application is a 35 U.S.C. §371 National Stage Entry of International Application No. PCT/EP2011/054572, filed Mar. 24, 2011, and claims the benefit of European Application No: 10305342.7, filed Apr. 2, 2010, which is incorporated by reference in its entirety herein.

BACKGROUND OF THE INVENTION

The present invention relates to a facing element for use in a stabilized soil structure. It also relates to a stabilized soil structure comprising said facing element and to a method for erecting a stabilized soil or reinforced earth structure. This building technique is commonly used to produce structures such as retaining walls, bridge abutments, etc.

A stabilized soil structure combines a compacted fill, a facing, and reinforcements usually connected to the facing. The reinforcements are placed in the soil with a density dependent on the stresses that might be exerted on the structure, the thrust forces of the soil being reacted by the soil-reinforcements friction.

The invention more particularly concerns the case where the reinforcements are in the form of fill reinforcement strips of synthetic material, for example based on polyester fibers.

The facing is most often made up of facing elements, as for example in the form of prefabricated concrete elements, such as slabs or blocks, juxtaposed to cover the front face of the structure. There may be horizontal steps on this front face between different levels of the facing, when the structure has one or more terraces.

The fill reinforcement strips placed in the fill are usually secured to the facing by mechanical connecting members that may take various forms. Once the structure is complete, the reinforcements distributed through the fill transmit high loads, in some cases of up to several tons. Their connection to the facing needs to be robust in order to maintain the cohesion of the whole.

A facing element comprises a front face and a rear face extending along a longitudinal direction X and an elevation direction Z and a body between said front and rear faces.

The body of some known facing elements comprises at least a hollow part with an opening on the rear face wherein a cylindrical core is cohesive with the body and arranged at least partly in the hollow part to form an anchoring region for a fill reinforcement strip.

Patent document U.S. Pat. No. 5,839,855 discloses examples of a facing element where a passage intended to receive a fill reinforcement strip is in the shape of a C within the thickness of the facing element.

Although preceding facing elements are widely and effectively used, one has noticed that their cylindrical cores usually break according to a bending mode when being pulled by fill reinforcement strips. This breaking mode may limit the efficiency of the anchoring region and has to be taken into account when designing a stabilized soil structure comprising said facing elements.

It is an object of the present invention to propose a novel facing element for use in a stabilized soil structure, making it possible to reduce the incidence of the problems set out above.

SUMMARY OF THE INVENTION

The invention thus proposes a facing element for use in a stabilized soil structure where the facing element comprises a front face and a rear face extending along a longitudinal direction X and an elevation direction Z, a body between said front and rear faces, said body comprising at least a hollow part with an opening on the rear face wherein a cylindrical core is cohesive with the body and arranged at least partly in the hollow part to form an anchoring region for a fill reinforcement strip, wherein the cylindrical core extends substantially parallel to the longitudinal direction X and its cross section, in a plane (Y, Z) perpendicular to the plane (X, Z), consists of two continuous parts separated by a virtual straight line along the direction Z, where the first part has a continuously decreasing size in the direction Y from the virtual straight line to an extremity substantially directed opposite to the rear face of the facing element and the second part has a continuously constant and/or decreasing size from the virtual straight line to an extremity directed to said rear face, and wherein:

$$L_2 \geq 1.1 \times d_1; \text{ and}$$

$$A \geq 0.24 \times d_1^2; \text{ wherein:}$$

$L_2$ is the distance between the extremity of the first part and the rear face measured according to the Y direction;

$d_1$ is the width of the cylindrical core measured according to the X direction at the extremity of the first part;

A is the area of the cross section of the cylindrical core in the plane (Y, Z).

Said shape and geometric characteristics of the facing element make possible to avoid breaking of the cylindrical core according to a bending mode when being pulled by fill reinforcement strips. The inventors have noticed that the cylindrical cores of said facing elements break according to a shearing mode.

When comparing samples broken according to those two different modes, one can notice that the cores of preceding known facing elements, that break according to a bending mode, break between their two extremities, roughly in the middle of said cores, whereas the cores of the facing elements according to the present invention break at their extremities, where they are cohesively attached with the body.

Alternatively, one can notice that cracks formed in the facing elements of the invention are formed within said body. Those cracks are usually formed in four approximately 45° directions in the (X, Z) plane when fill reinforcement strips pull in the Y direction.

The inventors have noticed that the breaking energy dissipated within the facing element according to the invention is significantly higher compared to the breaking energy dissipated when the cores break according to a bending mode.

One can then advantageously design stabilized soil structures with said facing elements. According to an embodiment, one can significantly reduce the thickness of the facing element according to the invention in comparison with a facing element as previously known and obtain similar pulling resistance for both facing elements.

According to further embodiments that can be considered alone or in combination:

the second part has a continuously decreasing size from the virtual straight line to the extremity directed to the rear face;

$$L_2 \geq 1.3 \times d_1;$$

$$A \geq 0.40 \times d_1^2;$$

$L_2/L_1 \geq 0.5$; wherein $L_1$ is the largest distance between the rear face and the front face measured according to a line passing through the cylindrical core along the Y direction;

the first part of the cylindrical core cross section is chosen in the list consisting of half-circle, half-ellipse, half-oval;

the second part of the cylindrical core cross section is chosen in the list consisting of half-circle, half-ellipse, half-oval, triangle, trapezoid quadrilateral, rectangle;

the body and the cylindrical core are cast together with the same cast material; the body and the cylindrical core may also be made of a different material; the cylindrical core may also be manufactured independently and then introduced within a mould in order to cast the body and to render the cylindrical core cohesive with the body;

the body is made of concrete;

the area A of the cross section of the cylindrical core is substantially constant along the X axis;

the facing element is in the form of a panel, and the distance $L_2$ between the extremity of the first part and the rear face is at least half of the thickness of the panel-shaped facing element.

The invention also relates to a stabilized soil structure, comprising fill reinforcement strips extending through a reinforced zone of a fill situated behind a front face of the structure and a facing placed along said front face and extending along a longitudinal direction X' and an elevation direction Z', the facing comprising at least a facing element according to the present invention and here above disclosed which directions X and Z are arranged so as to coincide with directions X' and Z' and fill reinforcement strips being arranged so as to form an open loop around the cylindrical core of the said facing element and said open loop being extended on each side by a segment of the fill reinforcement strip, said segments extending at least partly within the fill.

According to an embodiment of said stabilized soil structure, a surface of the said strip forming the open loop contacts and presses substantially the whole external periphery of the cross section of the first part of the cylindrical core, and at least a part of the external periphery of the cross section of the second part of the cylindrical core. According to said embodiment, compression load is applied at least partly around the cylindrical core. Said embodiment helps to further improve the pulling resistance of the anchoring region.

According to preceding embodiment a surface of the strip forming the open loop may contact a surface of the strip forming the pen loop contacts at least 20%, as for example at least 50% of the external periphery of the cross section of the second part of the cylindrical cohesive core.

According to an embodiment, the two segments extending the open loop come out of the facing through a same slot. According to another embodiment they come out through two different slots. Said two different slots may be in the same (X, Y) plane or be arranged in two separated (X, Y) planes.

The invention is also directed to a method for erecting a stabilized soil structure, comprising fill reinforcement strips extending through a reinforced zone of the fill situated behind a front face of the structure, and a facing placed along said front face and extending along a longitudinal direction X' and an elevation direction Z', the reinforcement strips being anchored to the facing in respective anchoring regions comprising the steps of:

a) erecting at least part of a facing by using at least a facing element according to the present invention and hereabove disclosed, arranged so as directions X and Z of the facing element coincide with directions X' and Z';

b) positioning in at least an anchoring region of the facing element of step a) a fill reinforcement strip so as to form an open loop around the cylindrical core of the said facing element and so that the open loop is extended on each side by a segment of the reinforcement strip;

c) introducing fill material over the said fill reinforcement strip and compacting it.

BRIEF DESCRIPTION OF THE DRAWINGS

Other features and advantages of the present invention will become apparent from the description below of some non-limiting illustrative embodiments, with reference being made to the attached drawings, in which.

DESCRIPTION OF EMBODIMENTS

Figure 1:
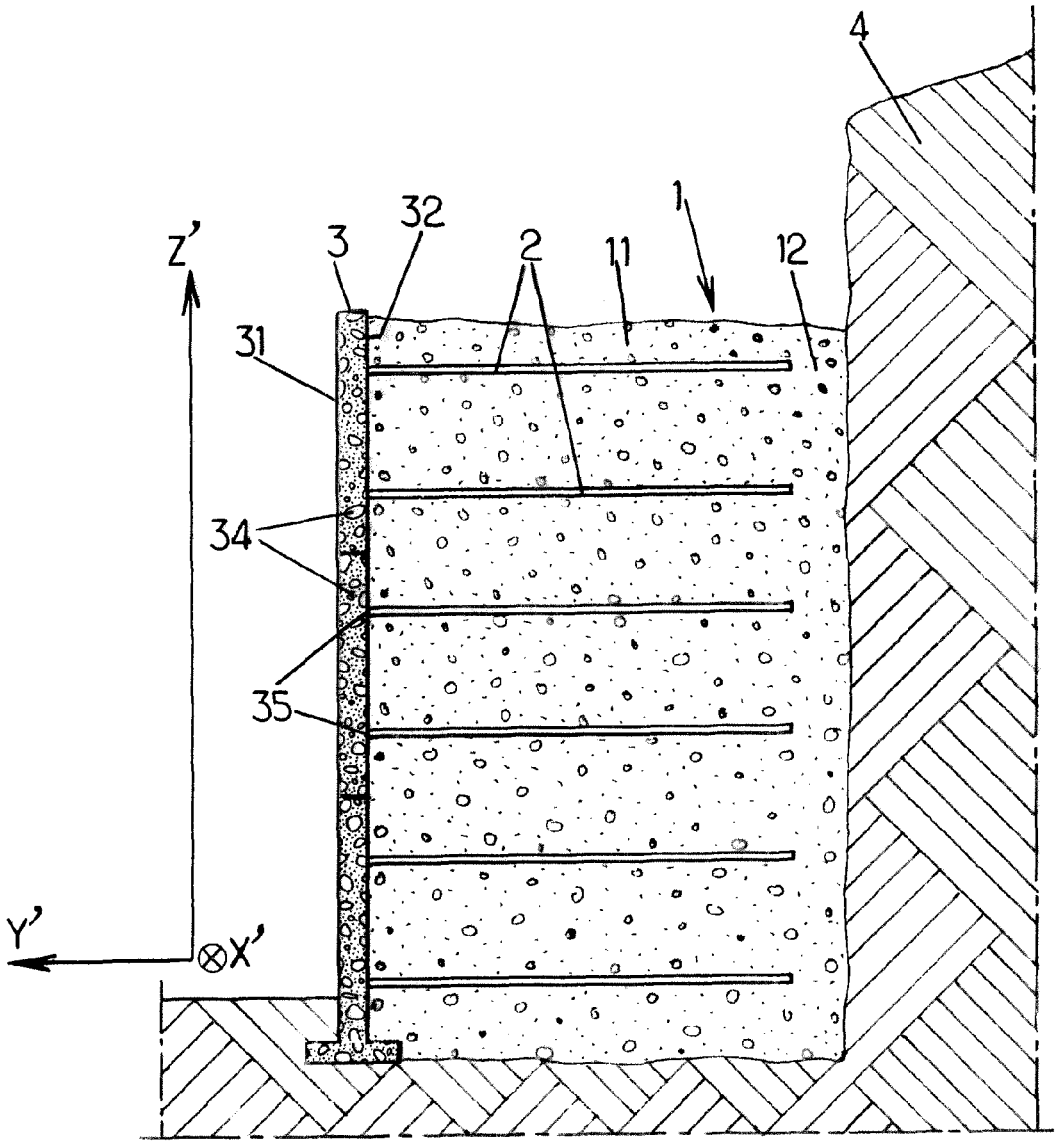
FIG. 1 is a schematic view in lateral section of a stabilized soil structure according to the invention in the process of being built.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention. Like reference characters in the different figures refer to similar parts.

FIG. 1 illustrates the application of the invention to the building of a stabilized soil retaining wall or stabilized soil structure before a face 4. A compacted fill 1, in which reinforcements 2 are distributed, is delimited on the front side of the structure by a facing 3 formed by juxtaposing facing elements such as prefabricated elements 34 in the form of panels, and on the rear side by the soil against which the stabilized soil structure wall is erected.

The facing 3 extends along a longitudinal direction X' and an elevation direction Z'. The facing 3 may be vertical or inclined.

The facing elements 34 have a front face 31 and a rear face 32.

Reinforcements extend through a reinforced zone 11 of the fill situated behind the front face of the structure. A zone 12 which does not comprise fill reinforcement strips may be located between the reinforced zone 11 and the face 4.

The reinforcements 2 comprise synthetic reinforcing members in the form of flexible strips extending in horizontal planes behind the facing 3. These may in particular be fill reinforcement strips based on polyester fibers encased in polyethylene.

The reinforcement strips 2 are attached in anchoring regions 35 to the prefabricated elements 34 joined together to form the facing 3. These elements 34 are typically made of reinforced concrete. In the example shown, they are in the form of panels. They could also have other forms, in particular the form of blocks. According to an example, when the concrete of such an element 34 is cast, one or more reinforcement strips 2 may be installed in the mould to provide the strip-element anchorage. After the concrete has set, each strip has two sections which emerge from the element and are to be installed in the fill material. According to another embodiment, the reinforcement strips are introduced in the anchoring regions 35 after placing the facing elements when erecting the structure.

For erecting the structure, the procedure may be as follows:

a) Placing some of the facing elements 34 so as then to be able to introduce fill material over a certain depth. In a known manner, the erection and positioning of the facing elements may be made easier by assembly members placed between them. The strips 2 are so positioned on the facing elements 34 that some of them are located at the same horizontal level when the facing is erected.

b) Introducing fill material 11, 12 and compacting it progressively until the next specified level for placement of the reinforcement strips 2 is reached.

c) Laying the reinforcement strips 2 on the fill at this level.

d) Introducing fill material over the reinforcement strips 2 which have just been installed. This fill material is compacted as it is introduced.

e) Repeating steps b) to d) if several levels of strips are provided per series of facing elements 34.

f) Repeating steps a) to e) until the upper level of the fill is reached.

During introduction and compacting of the fill material, the reinforcement strips 2 already placed at the lower levels experience tensioning. This tensioning results from the friction between the strips and the filled material and ensures the reinforcement of the structure. So that the tension is established under good conditions, it is advisable that the strips of one level emerge from their facing elements so that they are all correctly aligned with this level. It is also advisable that they are oriented horizontally as they emerge from the facing, so as to ensure that they do not twist in the filled material.

Figure 2:
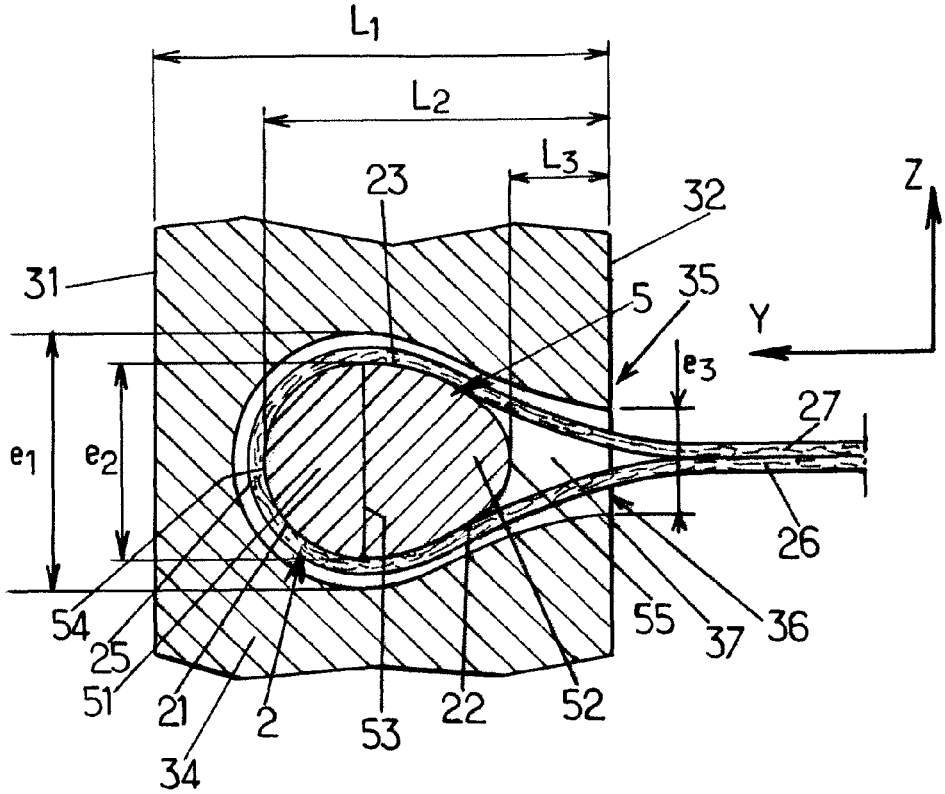
FIGS. 2 and 3 are partial cross sectional schematic views of a facing element according to an embodiment of the present invention, respectively according to planes (Y, Z) and (X, Y)
Figure 3:
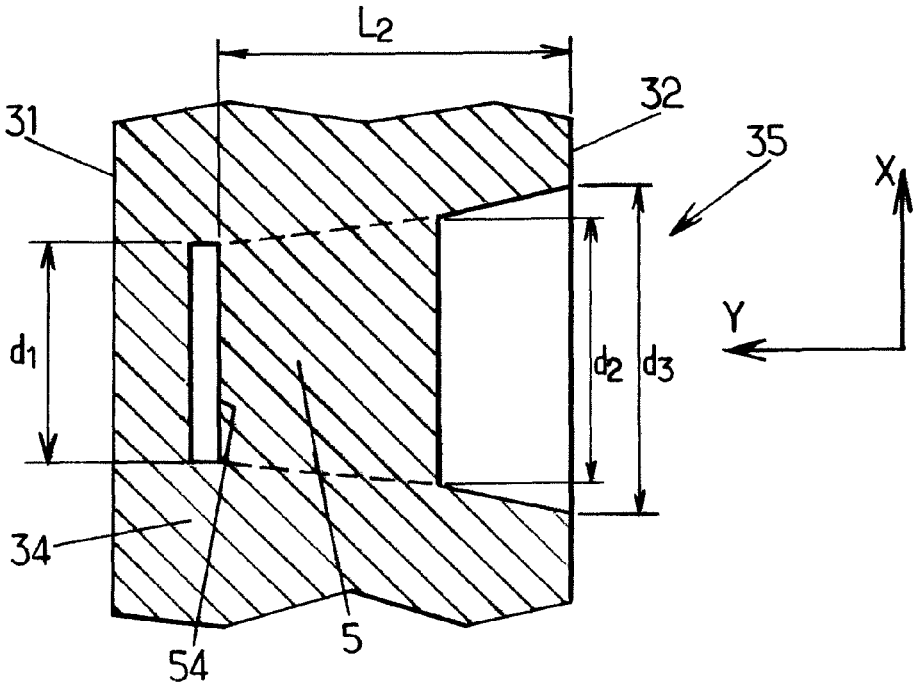

FIGS. 2 and 3 are partial cross sectional views of a facing element 34 according to an embodiment of the present invention where the facing element 34 comprises a front face 31 and a rear face 32 extending along a longitudinal direction X and an elevation direction Z, a body between said front and rear faces. Said body comprises at least a hollow part 37 with an opening 36 on the rear face 32 wherein a cylindrical core 5 is cohesive with the body and arranged at least partly in the hollow part 37 to form an anchoring region 35 for a fill reinforcement strip. The cylindrical core 35 extends substantially parallel to the longitudinal direction X and its cross section, in a plane (Y, Z) perpendicular to the plane (X, Z), consists of two continuous parts 51, 52 separated by a virtual straight line 53 along the direction Z, where the first part 51 has a continuously decreasing size in the direction Y from the virtual straight line 53 to an extremity 54 substantially directed opposite to the rear face 32 of the facing element and the second part 52 has a continuously decreasing size from the virtual straight line 53 to an extremity directed 55 to said rear face 32.

Main geometrical characteristics of said embodiment of a facing element according to the present invention are:

$L_1$ is the thickness of the facing element, that is the largest distance between the front face 31 and the rear face 32 measured according to a line passing through the cylindrical core 5 along the Y direction;

$L_2$ is the distance between the extremity 54 of the first part 51 and the rear face 32 measured according to the Y direction;

$L_3$ is the distance between the extremity 55 of the second part 52 and the rear face 32 measured according to the Y direction;

$d_1$ is the width of the cylindrical core 5 measured according to the X direction at the extremity 54 of the first part 51;

$d_2$ is the width of the cylindrical core 5 measured according to the X direction at the extremity 55 of the second part 52;

$d_3$ is the width of the opening 36 measured according to the X direction on the rear face 32;

$L_1$ is the largest distance of the hollow part 37 measured according to the Z direction, $L_2$ is the largest distance of the cylindrical core 5 measured according to the Z direction;

$L_3$ is the size of the largest part of the opening of the hollow part 37, measured according to the Z direction on the rear face 32;

A is the area of the cross section of the cylindrical core 5, measured in a plane (Y, Z).

According to embodiments not limited to the embodiment of FIGS. 2 and 3 and that can be generalized to other embodiments:

the thickness $L_1$ is a constant along the Z direction, and the thickness of the whole facing element may be constant according to the Y direction;

the distance $d_3$ is equal or greater than the distance $d_2$;

the distance $d_2$ is equal or greater than the distance $d_1$;

the extremity 55 is located inside the hollow part 37, and the distance $L_3$ is considered as being positive, as for example equal or greater than 10% of the distance $L_1$;

the line according to the Z direction corresponding to the largest distance of the hollow part 37 comprises the virtual straight line 53;

the distance $L_3$ is smaller than the distance $L_2$.

According to the present invention:

$$L_2 \geq 1.1 \times d_1; \text{ and}$$

$$A \geq 0.24 \times d_1^2$$

Thanks to the geometrical features of a facing according to the present invention, one can experimentally demonstrate that breaking of the cylindrical core occurs advantageously according to a shearing mode when being pulled by a fill reinforcement strip.

Resistance of said cylindrical core is even enhanced when $L_2 \geq 1.3 \times d_1$; and/or when $A \geq 0.40 \times d_1^2$ and/or when $L_2/L_1 \geq 0.50$.

According to the embodiment of FIGS. 2 and 3, the cylindrical core 5 and the hollow part 37 are symmetric according to a plane parallel to the (Y, Z) plane passing through the middle of said parts.

The first part 51 of the cylindrical core cross section is a half-circle and the second part of said core is a half-oval.

FIG. 2 also shows how a fill reinforcement strip 2 can be arranged in the anchoring region 35 of the facing element 34. The strip 2 is arranged so as to form an open loop 25 around the cylindrical core 5; said open loop 25 is extended on each side by a segment 26, 27 emerging from the facing element rear face 32 so as to be suitable to extend at least partly within a fill.

According to an embodiment a surface 21+22+23 of the strip 2 contacts the external surface of the core 5, the surface 21 presses substantially the whole external surface of the periphery of the cross section of the first part 51 of the cylindrical core and the surfaces 22 and 23 press a part of the external surface of the periphery of the cross section of the second part 52 of the cylindrical core 5. It has been demonstrated that the resistance of the cylindrical core is furthermore enhanced thanks to this embodiment.

FIGS. 4 to 12 show various examples of other embodiments of facing elements according to the present invention.

Figure 4:
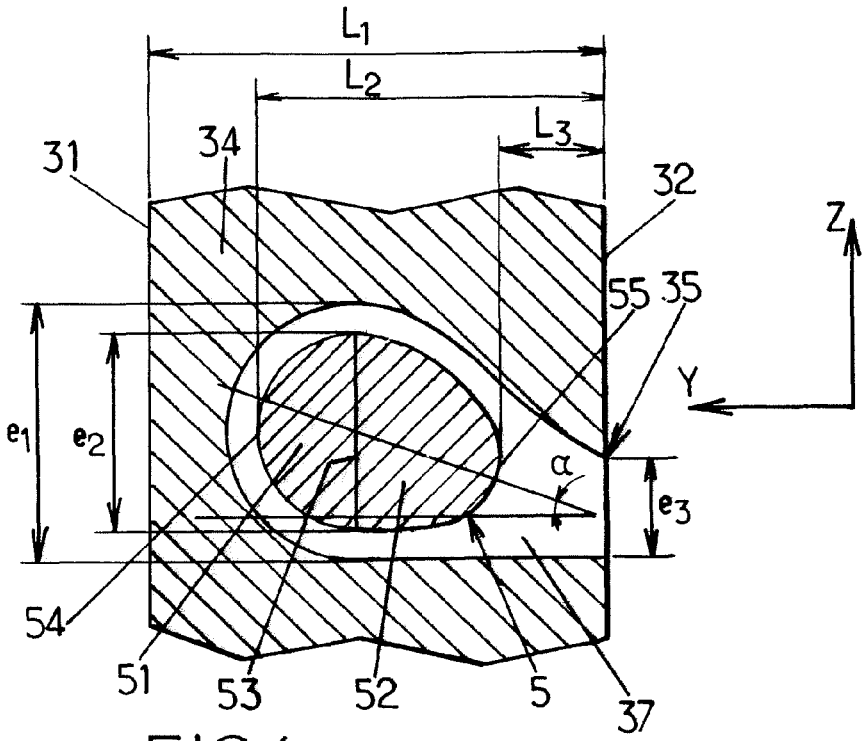
FIGS. 4 to 12*a* are partial cross sectional schematic views of other non limiting embodiments of the invention according to the plane (Y, Z) and FIG. 12*b* related to the embodiment of FIG. 12*a* drawn according to the plane (X, Y).

In the example of FIG. 4, the core 5 is tilted from an angle $\alpha$ compared to the position of the core 5 of FIG. 2.

Figure 5:
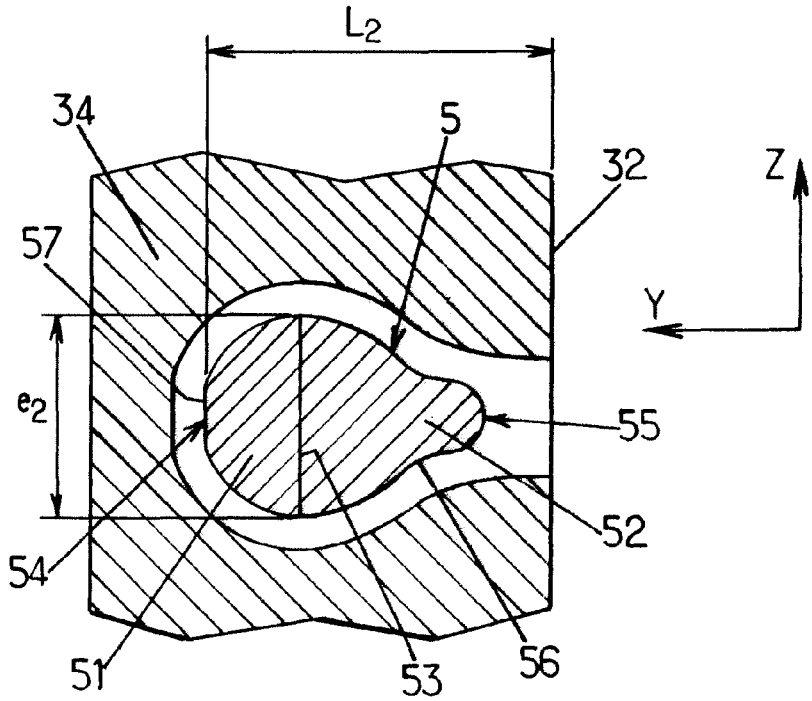

In the example of FIG. 5, the extremity 54, substantially directed opposite to the rear face 32 of the facing element, comprises a flat surface 57 located between two curved surfaces. In this example also, the second part 52 comprises an external reverse curved surface 56 from the virtual straight line 53 to the extremity 55.

Figure 6:
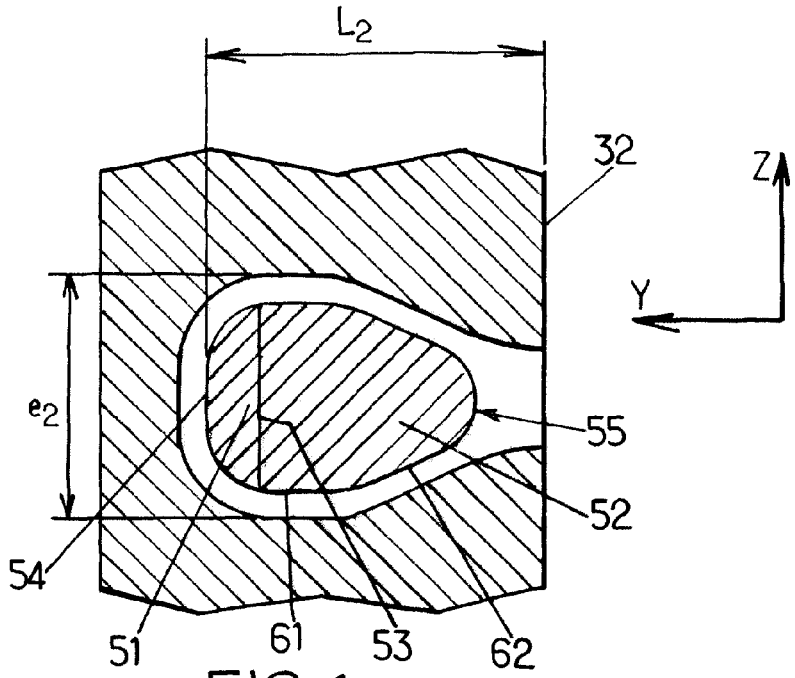

In the example of FIG. 6, the periphery of the cross section of the second part 52 is formed by two substantially straight lines 61 and 62 linked together by curved lines.

Figure 7:
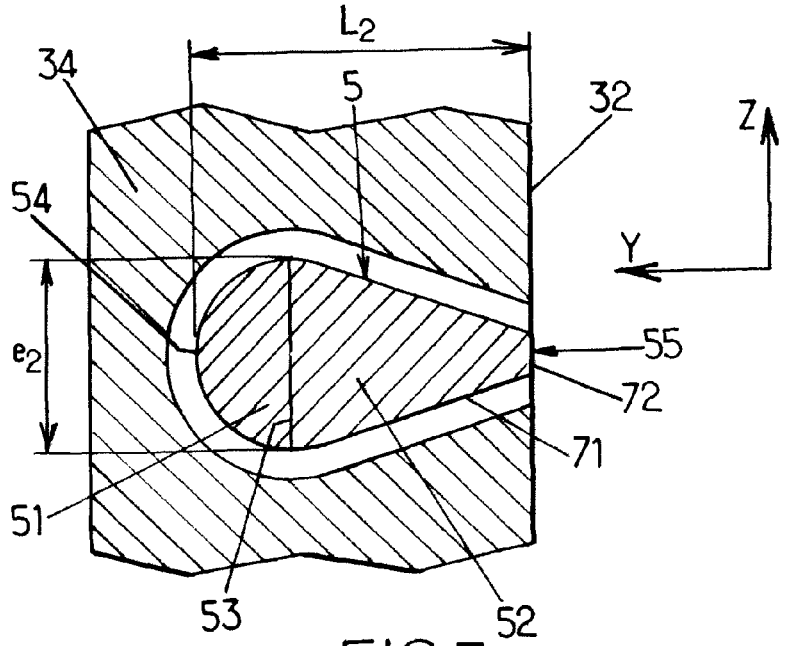

In the example of FIG. 7, the periphery of the cross section of the second part 52 is formed by a substantially straight line 71 which ends at the rear face 32 of the facing element.

The extremity of the periphery of the cross section of the second part 52 is formed by a straight line 72 merging with the rear face 32 of the facing element.

Figure 8:
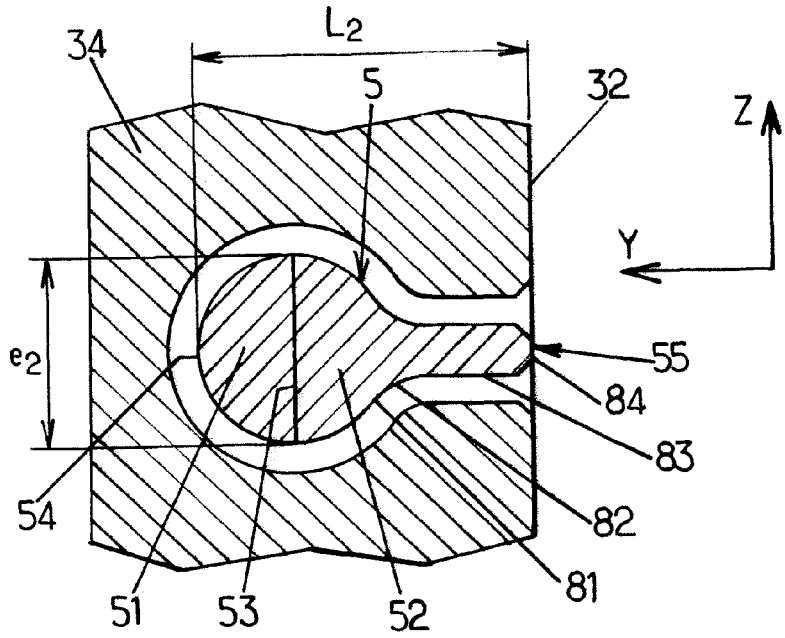

In the example of FIG. 8, the periphery of the cross section of the second part 52 is formed by a curved section 81, a reverse curve 82 followed by a substantially straight line 83 substantially parallel to the Y axis. The extremity of the said periphery is formed by a straight line 84 merging with the rear face 32 of the facing element.

Figure 9:
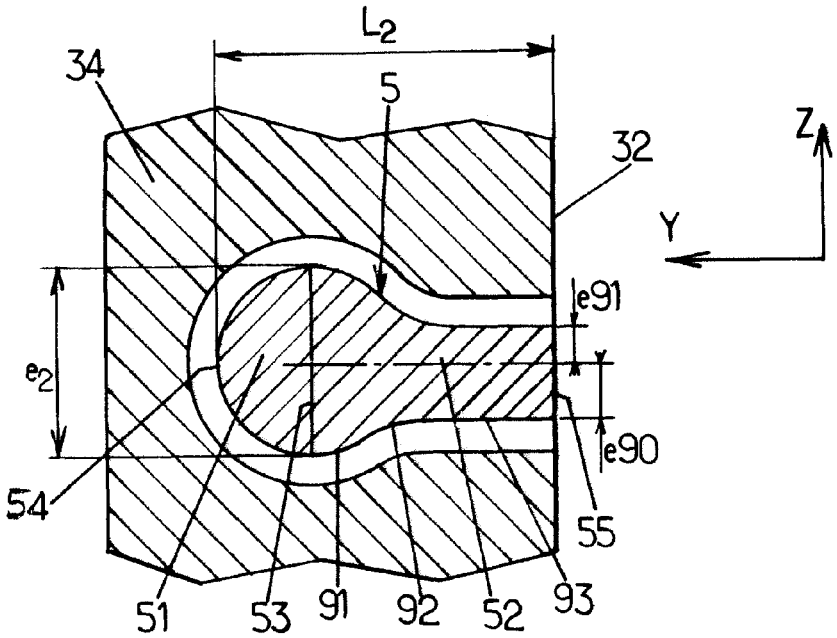

In the example of FIG. 9, the periphery of the cross section of the second part 52 is formed by a curved section 91, a reverse curve 82 followed by a substantially straight line 93 parallel to the Y axis. According to this embodiment, the cross section of the cylindrical core is non symmetric and the lowest part of said cross section is more flat than the upper part. The straight line of the extremity 55 of the core can be divided in two thicknesses e90 and e91 where e90 corresponds to the distance between a line according to the Y axis passing through the middle of line 53 and the lower part of the extremity of the cross section, whereas e91 corresponds to the distance between said line and the upper part of the extremity of the cross section. One has then e90 higher than e91.

Figure 10:
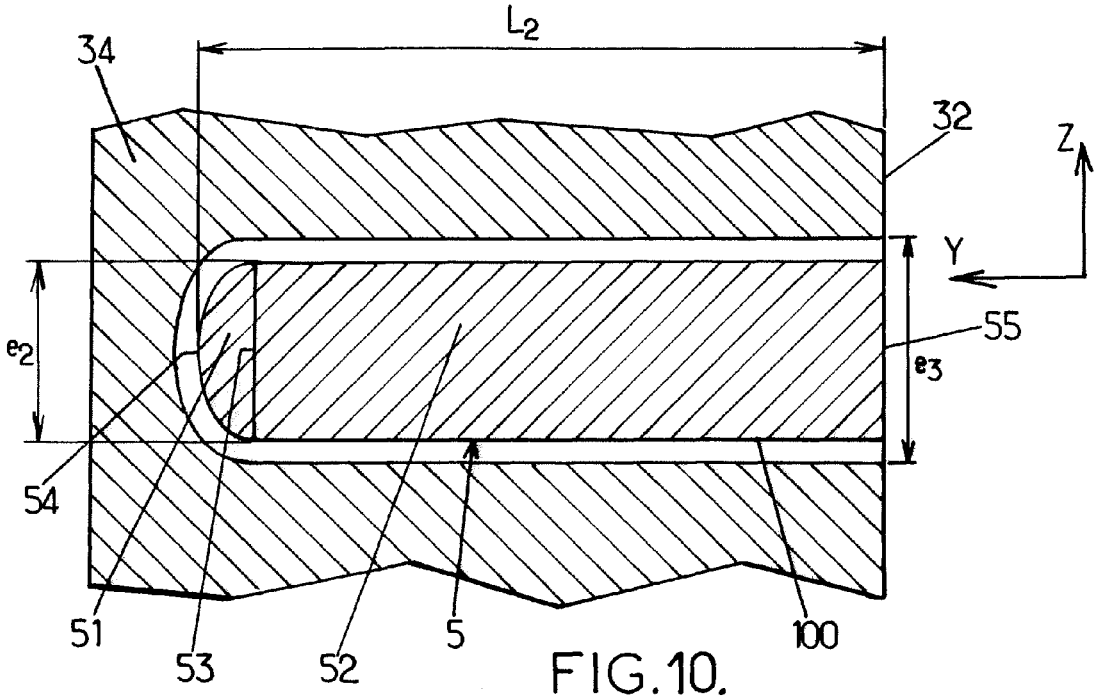

In the example of FIG. 10, the periphery of the cross section of the second part 52 is a rectangle limited by two parallel straight lines 100 parallel to the Y axis and by line 53 and the extremity 55 merging with the rear face 32. According to this embodiment e3 is equal to e1.

Figure 11:
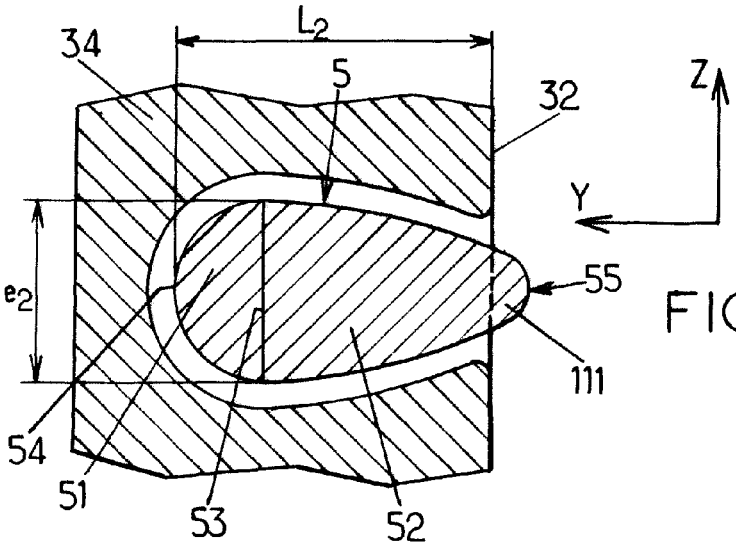

In the example of FIG. 11, the cylindrical core 5 protrudes out of the hollow part and a part 111 extents outside of the body of the facing element.

Figure 12A:
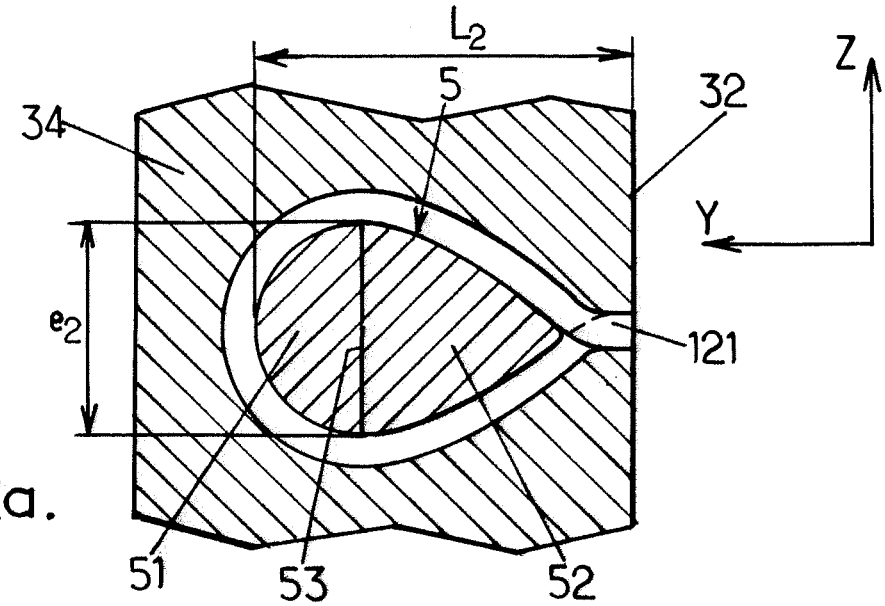
Figure 12B:
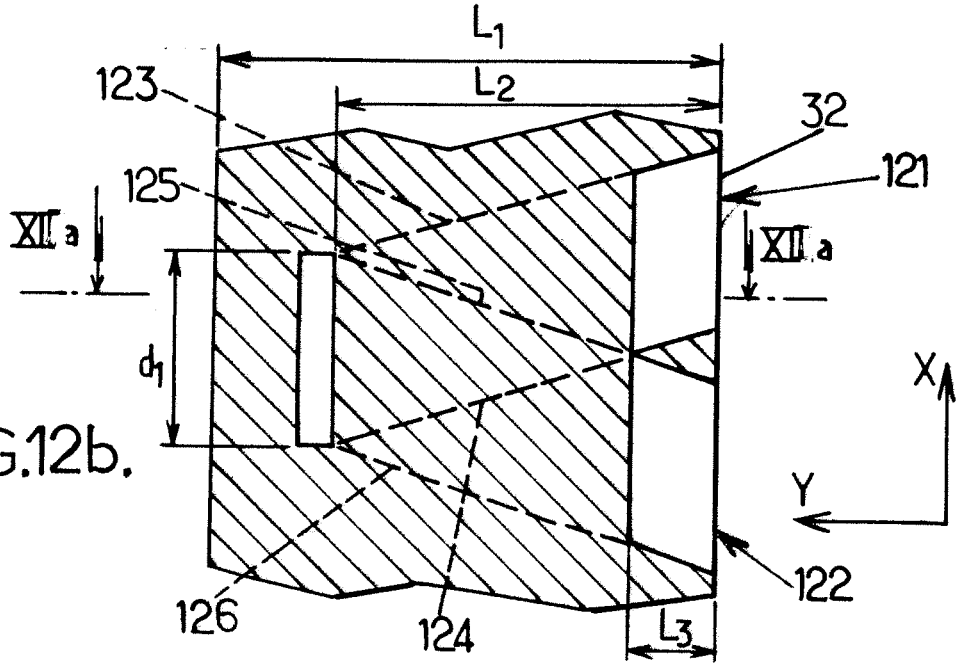

In the example of FIG. 12, the core 5 is designed so that the two segments of a fill reinforcement strip extending an open strip loop come out of the facing through two different slots 121, 122. According to the embodiment of FIG. 12, the two different slots are arranged in a same plane (X, Y). Lines 123, 124 limit the space for the segment that can emerge from slot 121 and lines 125, 126 limit the space for the segment that can emerge from slot 122.

Generally, the facing element of the invention and related method for erecting a stabilized soil structure are compatible with a large number of configurations of structure, strip lengths, densities for setting up strips, etc.

The invention claimed is:

1. A facing element for use in a stabilized soil structure, the facing element comprising:

a front face and a rear face extending along a longitudinal direction X and an elevation direction Z; and a body between said front and rear faces, said body comprising at least a hollow part with an opening on the rear face wherein a cylindrical core is cohesive with the body and arranged at least partly in the hollow part to form an anchoring region for a fill reinforcement strip, wherein the cylindrical core extends substantially parallel to the longitudinal direction X and has a cross section, in a plane (Y, Z) perpendicular to the plane (X, Z), made of two continuous parts separated by a virtual straight line along the direction Z, wherein the first part has a continuously decreasing size in the direction Y from the virtual straight line to an extremity substantially directed opposite to the rear face of the facing element, and the second part has a continuously constant and/or decreasing size from the virtual straight line to an extremity of the second part directed to said rear face, and wherein:

$$L_2 \geq 1.1 \times d_1; \text{ and}$$

$$A \geq 0.24 \times d_1^2,$$

where:

$L_2$ is a distance between said extremity of the first part and the rear face measured according to the Y direction;

$d_1$ is a width of the cylindrical core measured according to the X direction at said extremity of the first part);

A is the area of the cross section of the cylindrical core in the plane (Y, Z).

2. The facing element according to claim 1, wherein the second part has a continuously decreasing size from the virtual straight line to said extremity of the second part.

3. The facing element according to claim 1, wherein $L_2 \geq 1.3 \times d_1$.

4. The facing element according to claim 1, wherein $A \geq 0.40 \times d_1^2$.

5. The facing element according to claim 1, wherein $L_2/L_1 \geq 0.5$, where:

$L_1$ is the largest distance between the rear face and the front face measured according to a line passing through the cylindrical core along the Y direction.

6. The facing element according to claim 1, wherein the first part of the cylindrical core cross section is one of a half-circle, a half-ellipse, and a half-oval.

7. The facing element according to claim 1, wherein the second part of the cylindrical core cross section is one of a half-circle, a half-ellipse, a half-oval, a triangle, a trapezoid quadrilateral, and a rectangle.

8. The facing element according to claim 1, wherein the body and the cylindrical core are cast together with the same cast material.

9. The facing element of claim 1, wherein the facing element is in the form of a panel, and wherein the distance $L_2$ between said extremity of the first part and the rear face is at least half of the thickness of the panel-shaped facing element.

10. A stabilized soil structure, comprising:

a fill situated behind a front face of the structure;

fill reinforcement strips extending through a reinforced zone of the fill; and a facing placed along said front face and extending along a longitudinal direction X and an elevation direction Z, wherein the facing includes at least a facing element comprising:

a front face and a rear face extending along the longitudinal direction X and the elevation direction Z; and a body between said front and rear faces, said body comprising at least a hollow part with an opening on the rear face wherein a cylindrical core is cohesive with the body and arranged at least partly in the hollow part to form an anchoring region for one of the fill reinforcement strips forming an open loop around said cylindrical core, said open loop being extended on each side by a segment of the fill reinforcement strip, said segments extending at least partly within the fill, wherein the cylindrical core of the facing element extends substantially parallel to the longitudinal direction X and has a cross section, in a plane (Y, Z) perpendicular to the plane (X, Z), made of two continuous parts separated by a virtual straight line along the direction Z, wherein the first part has a continuously decreasing size in the direction Y from the virtual straight line to an extremity substantially directed opposite to the rear face of the facing element, and the second part has a continuously constant and/or decreasing size from the virtual straight line to an extremity of the second part directed to said rear face, and wherein:

$$L_2 \geq 1.1 \times d_1; \text{ and}$$

$$A \geq 0.24 \times d_1^2,$$

where:

$L_2$ is a distance between said extremity of the first part and the rear face measured according to the Y direction;

$d_1$ is a width of the cylindrical core measured according to the X direction at said extremity of the first part;

A is the area of the cross section of the cylindrical core in the plane (Y, Z).

11. The stabilized soil structure of claim 10, wherein a surface of the said strip forming the open loop contacts and presses substantially the whole external periphery of the cross section of the first part of the cylindrical core, and at least a part of the external periphery of the cross section of the second part of the cylindrical core.

12. The stabilized soil structure of claim 11, wherein a surface of the strip forming the open loop contacts at least 20% of the external periphery of the cross section of the second part of the cylindrical cohesive core.

13. The stabilized soil structure of claim 10, wherein the two segments extending the open strip loop come out of the facing through a same slot.

14. The stabilized soil structure of claim 10, wherein the two segments extending the open strip loop come out of the facing through two different slots.

15. A method for erecting a stabilized soil structure, comprising fill reinforcement strips extending through a reinforced zone of a fill situated behind a front face of the structure, and a facing placed along said front face and extending along a longitudinal direction X and an elevation direction Z, the reinforcement strips being anchored to the facing in respective anchoring regions, the method comprising:

a) erecting at least part of a facing including at least one facing element;

b) positioning in at least an anchoring region of the facing element a fill reinforcement strip so as to form an open loop around a cylindrical core of said facing element extending substantially parallel to the longitudinal direction X, and so that the open loop is extended on each side by a segment of the reinforcement strip;

c) introducing fill material over said fill reinforcement strip; and d) compacting the fill material, wherein the facing element comprises:

a front face and a rear face extending along the longitudinal direction X and the elevation direction Z; and a body between said front and rear faces, said body comprising at least a hollow part with an opening on the rear face wherein a cylindrical core is cohesive with the body and arranged at least partly in the hollow part to form an anchoring region for the fill reinforcement strip, wherein the cylindrical core has a cross section, in a plane (Y, Z) perpendicular to the plane (X, Z), made of two continuous parts separated by a virtual straight line along the direction Z, wherein the first part has a continuously decreasing size in the direction Y from the virtual straight line to an extremity substantially directed opposite to the rear face of the facing element, and the second part has a continuously constant and/or decreasing size from the virtual straight line to an extremity of the second part directed to said rear face, and wherein:

$$L_2 \geq 1.1 \times d_1; \text{ and}$$

$$A \geq 0.24 \times d_1^2,$$

where:

$L_2$ is a distance between said extremity of the first part and the rear face measured according to the Y direction;

$d_1$ is a width of the cylindrical core measured according to the X direction at said extremity of the first part;

A is the area of the cross section of the cylindrical core in the plane (Y, Z).

* * * * *